US008448820B2

(12) United States Patent
Johnson

(10) Patent No.: US 8,448,820 B2
(45) Date of Patent: May 28, 2013

(54) POPPET SEAL FITMENT FOR A COLLAPSIBLE BAG

(75) Inventor: James W. Johnson, Delaware, OH (US)

(73) Assignee: Liqui-Box Corporation, Worthington, OH (US)

( * ) Notice: Subject to any disclaimer, the term of this patent is extended or adjusted under 35 U.S.C. 154(b) by 562 days.

(21) Appl. No.: 12/683,839

(22) Filed: Jan. 7, 2010

(65) Prior Publication Data

US 2010/0176151 A1 Jul. 15, 2010

Related U.S. Application Data

(60) Provisional application No. 61/143,617, filed on Jan. 9, 2009.

(51) Int. Cl.
*B67D 7/06* (2010.01)

(52) U.S. Cl.
USPC ..... 222/92; 222/490; 222/494; 222/542; 222/567

(58) Field of Classification Search
USPC ..... 222/81, 83, 83.5, 92, 105, 107, 490–494, 222/499, 501, 542, 566, 567, 570, 571, 573; 137/798, 846, 847; 383/906; 141/329, 330
See application file for complete search history.

(56) References Cited

U.S. PATENT DOCUMENTS

| | | | | |
|---|---|---|---|---|
| 2,556,571 | A * | 6/1951 | Bobbs et al. | 222/92 |
| 4,353,488 | A * | 10/1982 | Schneiter et al. | 222/501 |
| 4,436,125 | A | 3/1984 | Blenkush | |
| RE32,354 | E * | 2/1987 | Savage | 222/81 |
| 7,195,138 | B2 * | 3/2007 | Foster et al. | 222/494 |
| 2006/0144875 | A1 * | 7/2006 | Etesse | 222/494 |

FOREIGN PATENT DOCUMENTS

WO WO2004/085283 A1 10/2004

OTHER PUBLICATIONS

The International Search Report and Written Opinion of the International Searching Authority, Application No. PCT/US2010/020347, Mailed May 7, 2010.

* cited by examiner

*Primary Examiner* — J. Casimer Jacyna
(74) *Attorney, Agent, or Firm* — Potter Anderson Corroon LLP; Rakesh H. Mehta, Esq.

(57) ABSTRACT

Disclosed herein is a fitment for use with a collapsible bag for dispensing liquids or semi solids comprising a spout having a generally cylindrical body attached to a collapsible bag, a cap attached to the spout having positioned therein a flexible poppet that allows for the flow of fluid when engaged with a probe assembly.

12 Claims, 3 Drawing Sheets

DAIRY POPPET CAP EXPLODED ASSEMBLY

POPPET CAP EXPLODED ASSEMBLY

POPPET SEAL FITMENT FOR A COLLAPSIBLE BAG

CROSS-REFERENCE TO RELATED APPLICATION

This application claims priority from provisional U.S. Patent Application No. 61/143,617 filed Jan. 9, 2009, which is incorporated by reference herein in its entirety.

FIELD OF THE INVENTION

The present disclosure relates to a fitment for use with a collapsible container for dispensing liquids and semi-solids from the bag. More particularly the present disclosure relates to a poppet seal fitment for use on a collapsible container for dispensing liquids and semi-solids from the container.

BACKGROUND OF THE INVENTION

Many systems are used for dispensing liquids or semi-solids from a disposable package consisting of a flexible collapsible bag in a corrugated box, commonly referred to as a bag-in-box dispensing package. Generally, these systems include a bag that is provided with a fitment in the form of a spout through which filling and dispensing occur. It is generally desirable to provide a quick-disconnect coupling between the spout and the service line of the pump or other type of beverage mixing and dispensing system.

However, these closures often employ complicated sealing structures for providing an adequate seal in preventing product spill. In the past, elastomeric check-valves and O-ring seals have been employed. Furthermore, these closure valves are not cost effective, as multiple parts are required for assembly.

Typically, these fluid couplings use connection types that include an insert and/or cap connected with a fluid source, such as a bag or a bag-in-box. The insert is coupled with a connector or coupler body that can access a fluid dispensing system, such as a fluid line. Many times, such connectors employ a piercing member at one end so as to puncture a membrane seal disposed on the insert when the connector is mated with the insert for fluid dispensing. Further, such connectors used to mate with the insert on the fluid source are produced so as to be reusable.

There is also a need for coupling valve assemblies that can be reused with a variety of connections. The present invention provides a non-disposable coupling valve assembly that can be utilized with a variety of fluid conduit adaptors.

Disposable containers are routinely used in commercial and industrial applications to transport and dispense a variety of fluids, such as food products, cleaning solutions, detergents, and other products. Some containers are constructed of semi-rigid plastic while others are constructed of flexible plastic and are often supported within a protective box.

It is common for such containers to be equipped with valve structures that facilitate dispensing fluids to or from the containers. The valve structures are preferably designed to quickly couple with exterior coupling members.

The female coupling includes a releasable locking or quick-connecting/disconnecting mechanism for locking the male and female couplings together in a coupled state. U.S. Pat. No. 4,436,125 discloses a quick connect/disconnect coupling assembly. A female coupling member includes a poppet valve assembly which functions as an automatic shut-off of the fluid passageway in the female coupling member when the female coupling member is not interconnected to the male coupling member.

SUMMARY OF THE INVENTION

One aspect is for a fitment for use on a collapsible bag for dispensing of liquids and semi-solids from the bag; wherein the fitment comprises the following:

(a) a spout having a generally hollow cylindrical body having an external surface capable of mating with a cap, the spout having at one end a base portion for securing the spout to the collapsible bag;

(b) a cap having an outer collar and an inner collar with the outer collar and inner collar each having an inner and outer surface, the inner surface of the outer collar and the outer surface of the inner collar forming a cavity adapted to be removably attachable to the spout, the inner surface of the inner collar being capable of attaching to a poppet, the cap further comprising a hollow cylinder section comprising a proximal end and a distal end with each having an inner and outer surface, the cylinder section being fixedly attached at its distal end to the inner collar, the inner surface of the inner collar and the outer surface of the proximal end of the cylinder forming a cavity, the cap optionally comprising a flange fixedly attached to the outer surface of the outer collar;

(c) a poppet of a flexible, non-porous, plastic or elastomeric material, the poppet comprising an essentially dome-shaped central portion, an upper surface of which is in contact with the proximal end of the cap and which forms a seal with the cap that can be unsealed by a probe, the poppet further comprising a perforated section extending from a lower portion of the dome, the perforated section being curved upwards as compared to the lower portion of the dome so that the perforated section and the dome form a cavity on the upper surface of the poppet, the perforated section comprising at least one slit and further comprising an end which comprises a flange capable of attaching to the inner surface of the inner collar of the cap to form a seal, the dome of the poppet being capable of partially collapsing upon contact of the upper surface of the poppet by a probe, the collapsing dome permitting fluid flow from the spout to travel through the at least one slit of the perforated section; and (d) a slidably removable probe.

Other objects and advantages will become apparent to those skilled in the art upon reference to the detailed description that hereinafter follows.

DETAILED DESCRIPTION OF THE INVENTION

Applicants specifically incorporate the entire contents of all cited references in this disclosure. Further, when an amount, concentration, or other value or parameter is given as either a range, preferred range, or a list of upper preferable values and lower preferable values, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

Definitions

In the context of this disclosure, a number of terms shall be utilized.

As used herein, the term "about" or "approximately" means within 20%, preferably within 10%, and more preferably within 5% of a given value or range.

The term "comprising" is intended to include embodiments encompassed by the terms "consisting essentially of" and "consisting of". Similarly, the term "consisting essentially of" is intended to include embodiments encompassed by the term "consisting of".

Fitment

The fitment is attached to the liquid container which usually is a flexible bag of a plastic material or a semi-rigid container also of a plastic material that holds liquids or semi-solids that are to be dispensed. The fitment can be tailored to the size of the bag or container so that a desired level of flow can be achieved. A wide variety of liquids or semi-solids can be dispensed using the fitment, such as liquid foods, like coffee, soda, milk, cooking oil and the like, or liquid chemicals of various types like hand soap, pastes, glue and the like.

Figure 1:
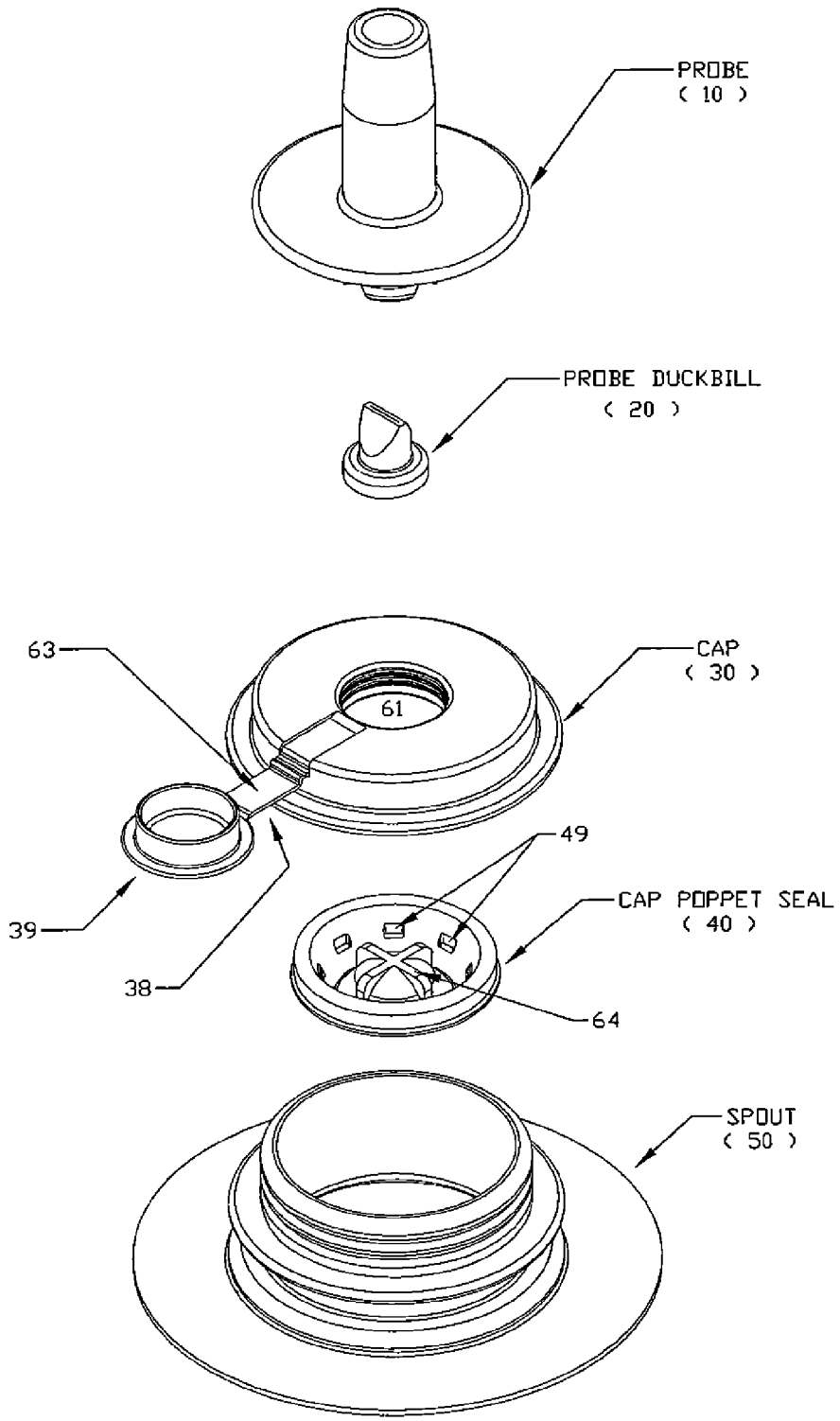
FIG. 1 is a view of an exploded assembly of the fitment.

FIG. 1 shows an exploded view of an assembly of the fitment of this invention. A probe 10 is in contact with probe duck bill 20 and the probe 10 and probe duck bill 20 are positioned in and form a seal in cap 30 shown having an optional flip lid 39. Cap poppet seal 40 is fitted into cap 30 and held in place by spout 50 that is attached to bag 60 shown in FIG. 2.

The probe 10 through which material from the bag 60 is dispensed typically is a molded thermoplastic material usually a polyolefin, such as, polyethylene, copolymers and terpolymers of polyethylene, polypropylene, copolymers and terpolymers of polypropylene, polybutylene and copolymers and terpolymers thereof, fluorocarbon polymers and copolymers thereof, polyvinyl chloride and copolymers thereof, polyvinylidene chloride and fluorocarbon polymers and copolymers thereof. Thermosetting polymers such as epoxy resins, phenolic resins, melamine resins can also be used for dispersing some substances. Preferably, polyethylene, polypropylene and copolymers and terpolymers thereof are used for most applications.

Figure 2:
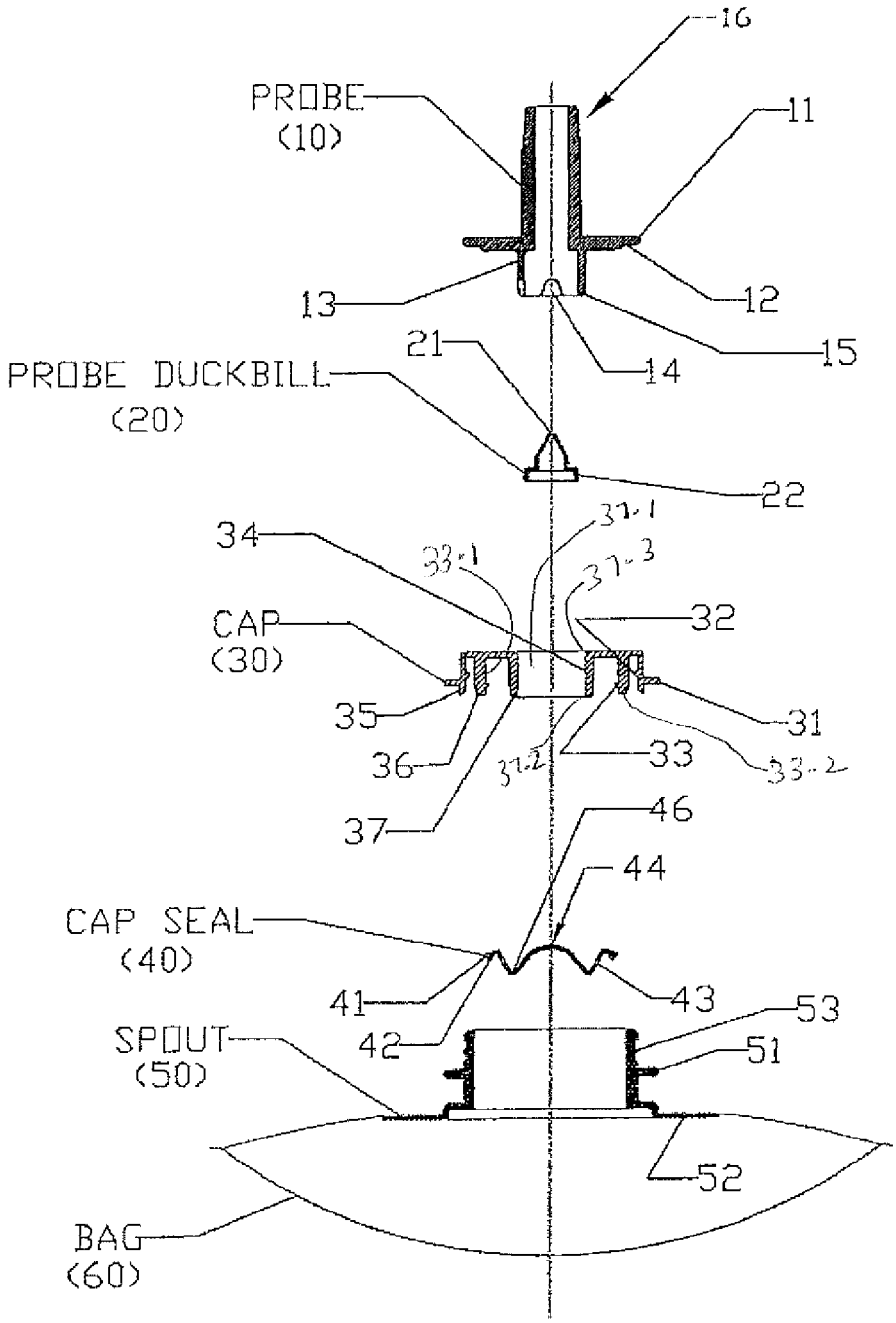
FIG. 2 is a cross section view of the fitment.

FIG. 2 shows a cross section of the fitment of FIG. 1 without the flip lid 39 attached to the cap 30. The probe 10 has a nozzle 16 and a flange 11 molded to the nozzle 16 that presses against the cap 30. The flange 11 is reinforced with a flange-strengthening rib 12. FIG. 2 also shows a locking bead 13 having at least two and preferably four product flow slots 14 through which product flows from bag 60. The probe 10 need not have these product flow slots 14 and still be operative and allow for flow of fluid from the bag or container. The locking bead 13 attaches the probe 10 to the cap 30 is molded to flange-strengthening rib 12.

Typically, probe 10 is a molded plastic part. Probe lead-in 15 engages with the cap seal lock 34 of the cap 30.

The total length of the probe 10 is about 1-2 inches, typically 1.4 inches, and the nozzle 16 of the probe 10 is about 0.25 to 0.5 inch, and typically 0.34 inch. The outer diameter of the nozzle 16 of the probe is about 0.5 inches and the flange 11 that presses against the cap 30 depends on the width of the cap but typically is about 1.325 inches in diameter. Typically, the thickness of the probe wall 10 is about 0.095 inch in the nozzle section and about 0.05 inch at the seal at the edge of the flange 11.

The inner diameter of the nozzle 16 of the probe 10 is about 0.25 inch and a variety of hoses typically can be attached to the nozzle 16. Typically, the hoses are attached to the nozzle 16 by a friction fit of the hose to the nozzle; however, other methods also can be used, such as, a hose clamp. In the alternative, the exterior of the nozzle may be provided with ribs or with a roughened surface for a better friction fit.

The probe duck bill 20 is a molded elastomeric product or a soft flexible plastic material having a duck bill product flow opening 21 and duck bill seal 22 fitting into the bottom of the probe 10 and engages the inner wall of the nozzle 16. The duckbill product flow opening 21 of the duck bill 20 typically is a re-closable opening, such as a slit in the duck bill 20 that allows fluid to flow from the bag 60 upon engagement of the probe 10 by application of a downward force applied to the duck bill 20. The product flow opening 21 of the duck bill 20 can be sealed with a thin layer of material that is broken when probe 10 engage. In the alternative, the opening itself can be sealed but is rendered re-sealable on engagement of the probe 10 when the probe is disengaged. The duck bill seal 22 fits into cap 30 and forms a seal with cap probe seal bead 34. Optionally, the duck bill 20 can be attached permanently to the cap 30 by welding or heat sealing it to the cap 30.

The probe duck bill 20 is an optional feature of the present invention. The primary advantage of the use of the duck bill 20 is to prevent back flow through the probe-10 when the probe is not engaged and the hose attached to the probe 10 is removed. The duck bill shape, as shown in FIG. 1, is preferred but other shapes can be used that would provide the same function.

Typically, the length of the duck bill 20 is from about 0.375 to 1.000 inch and the width about 0.3 inch but these dimensions may vary depending on the design of the fitment.

The duck bill 20 is molded from an elastomeric material or soft flexible plastic material that can withstand the effects of the fluid being dispensed. Typically useful elastomers are styrene/butadiene copolymers, butyl rubbers, polysulfide rubbers, polyisoprene, ethylene-propylene terpolymers (EPDM rubber), silicone rubbers, polyurethane rubbers, and the like. A soft flexible plastic material that can be used is a linear low molecular weight polyethylene or copolymer and blends thereof.

The cap 30 is a molded plastic part preferably formed of polyethylene but any of the aforementioned thermoplastics can be used. The cap 30 has a cap handling flange 31 for holding the cap 30 while it is being inserted or removed. The cap handling flange 31 is molded to the cap skirt 35 which in turn is molded to the cap cork bottom 36 which forms a circular channel ring opening or collar shown as a U-shape in FIG. 2. This circular ring opening fits over the spout 50 and in particular over the spout sealing bead(s) 53. Cap lock bead 32 of the cap 30 molded to the interior side of the cap skirt 35 engages with the spout sealing bead(s) 53 to form a liquid tight seal. The cap seal seal-bead 37 is molded to the cap cork bottom 36 of the cap 30 and forms a seal with the probe lock bead 13 of the probe 10. The cap cork bottom 36 and the cap seal seal-bead 37 form a circular channel ring opening shown or collar as a U shape in FIG. 2. The poppet seal lock 41 and the poppet seal rib 42 fit into this circular channel ring of the cap 30 and cap seal lock 33 molded to the interior side of the cap cork bottom 36 holds the cap poppet seal 40 in place by engaging with the poppet seal lock 41.

Figure 3:
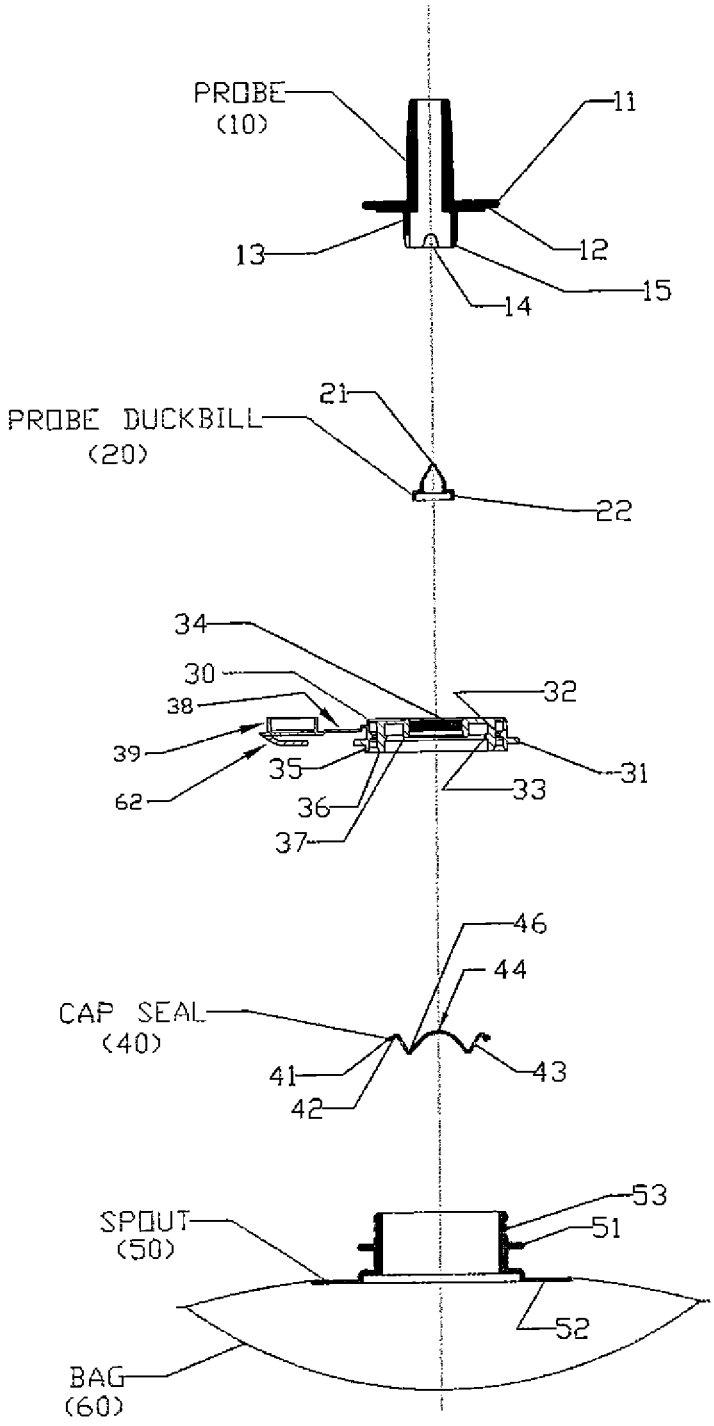
FIG. 3 is a cross section view of the fitment showing a cap with a flip lid.

FIG. 3 is a cross section view of the fitment showing a cap with flip lid 39, which is an optional feature of the fitment (also shown in FIG. 1). The flip lid 39 is attached to the cap 30 by hinge 38 which can be moved and engaged with the opening 61 of the cap 30 and forms a seal to retain liquid in the bag 60 when the probe 10 is not inserted into or when it is removed from the opening 61 of the cap 30. Also, a seal of a thin film of plastic, coated paper, metal foil and the like can be sealed over the opening 61 of the cap 30 to keep liquid product in the bag 60 fresh and prevent spoilage. This seal can readily be removed, broken, or punctured at the time when product is to be removed from the bag 60. A pull tab 62 is molded to the flip lid 39 for easy opening and closing of the flip lid 39. As shown in FIG. 1, flip lid 39 attached to cap 30 by hinge 38, wherein hinge 38 fits into recessed area 63 of the cap 30 allowing the flip lid 39 to recess into the circular opening 61 of the cap 30 thereby providing a level and even surface to the top of cap 30 when flip lid 39 is in a closed position.

The cap poppet seal 40 is a molded flexible non-porous plastic or elastomeric material. Any of the aforementioned elastomeric or plastic materials may be used and a preferable plastic is a polyolefin, particularly polyethylene. As mentioned above, the poppet seal lock 41 and the poppet seal rib 42 are engaged with the cap 30. The poppet seal dome 44 (also cap) of the poppet seal 40 is the dome shaped central portion of the poppet seal 40 and has a perforated section (shown as openings 49 in FIG. 1). The cap poppet seal seal-area 46 is in contact with the proximal end of the cap (cap seal bead 37). When the poppet seal dome 44 comes into contact with the probe via probe lead 15, the dome partially collapses and permits fluid to flow from the bag 60 through the openings 49 in the dome 44 and out to the probe 10 and into any hose connected thereto. FIG. 1 shows a cross of ribs 64 molded into the cap poppet seal 40 which come into contact with probe lead-in 15 of the probe thereby collapsing the poppet seal dome 44 to allow for flow of liquid and when the probe 10 is removed a seal is formed to prevent flow of liquid from the bag 60.

Spout 50 is attached to bag 60 via the molded sealing flange 52. Typically, the sealing flange 52 is heat sealed to the bag or container. There is a molded spout handling ring 51 on spout 50 for holding and handling bag 60 and a molded spout seal bead(s) 53 securely holds the cap 30 in place. The spout 50 is formed from any of the aforementioned thermoplastic materials. Polyethylene is preferred.

In one embodiment, the present invention relates to a fitment for use on a collapsible bag for dispensing of liquids and semi-solids from the bag, the fitment comprising:

(a) a spout comprising a generally hollow cylindrical body having an external surface capable of mating with a cap, the spout having at one end a base portion for securing the spout to the collapsible bag;

(b) a cap having an outer collar and an inner collar with the outer collar and the inner collar each having an inner and outer surface, the inner surface of the outer collar and the outer surface of the inner collar forming a cavity adapted to be removably attachable to the spout, the inner surface (33.1) of the inner collar (33,2) being capable of attaching to a poppet, the cap further comprising a hollow cylinder section (37.1) comprising a proximal end (37.2) and a distal end (37.3) with each having an inner and outer surface, the cylinder section being fixedly attached at its distal end to the inner collar, the inner surface of the inner collar and the outer surface of the proximal end of the cylinder forming a cavity, the cap optionally comprising a flange fixedly attached to the outer surface of the outer collar;

(c) a poppet comprising a flexible, non-porous, plastic material or elastomeric material, the poppet comprising an essentially dome-shaped central portion, an upper surface of which is in contact with the proximal end of the cap and which forms a seal with the cap that can be unsealed by a probe, the poppet further comprising a perforated section extending from a lower portion of the dome, the perforated section being curved upwards as compared to the lower portion of the dome so that the perforated section and the dome form a cavity on the upper surface of the poppet, the perforated section comprising at least one slit and further comprising an end which comprises a flange capable of attaching to the inner surface of the inner collar of the cap to form a seal, the dome of the poppet being capable of partially collapsing upon contact of the upper surface of the poppet by a probe, the collapsing dome permitting fluid flow from the spout to travel through the at least one slit of the perforated section; and (d) a slidably removable probe.

In another embodiment, the above described fitment cap further comprises a flip-top lid joined to the cap by a hinge which allows the flip-top lid to move between a closed position on the cap whereby the hollow cylinder section is covered and an open position away from the hollow cylinder. In yet another embodiment, in the above described fitments, the cap and the flip-top lid have a means for locking the flip-top lid in the closed position on the cap.

In yet another embodiment, in the above described fitments, the probe is a machine probe.

In another embodiment, in the above described fitments, the cap and the flip-top lid have a means for locking the flip-top lid in the closed position on the cap.

The invention as fully described above may embody other specific forms or variations without departing from its spirit or essential characteristics. In that regard, the embodiments described above are to be considered in all respects as illustrative and not restrictive, the scope of the invention being indicated by the claims rather than by the foregoing description and any and all changes which come within the meaning and range of equivalency of the claims are intended to be embraced therein.

What is claimed is:

1. A fitment for use on a collapsible bag for dispensing of liquids and semi-solids from the bag, the fitment comprising:

(a) a spout comprising a generally hollow cylindrical body having an external surface capable of mating with a cap, the spout having at one end a base portion for securing the spout to the collapsible bag;

(b) a cap having an outer collar and an inner collar with the outer collar and the inner collar each having an inner and outer surface, the inner surface of the outer collar and the outer surface of the inner collar forming a cavity adapted to be removably attachable to the spout, the inner surface of the inner collar being capable of attaching to a poppet, the cap further comprising a hollow cylinder section comprising a proximal end and a distal end with each having an inner and outer surface, the cylinder section being fixedly attached at its distal end to the inner collar, the inner surface of the inner collar and the outer surface of the proximal end of the cylinder forming a cavity;

(c) said poppet comprising a flexible, non-porous, plastic material or elastomeric material, the poppet comprising an essentially dome-shaped central portion, an upper surface of which is in contact with the proximal end of the cap and which forms a seal with the cap that can be unsealed by a probe, the poppet further comprising a perforated section extending from a lower portion of the dome, the perforated section being curved upwards as compared to the lower portion of the dome so that the perforated section and the dome form a cavity on the upper surface of the poppet, the perforated section further comprising an end which comprises a flange capable of attaching to the inner surface of the inner collar of the cap to form a seal, the dome of the poppet being capable of partially collapsing upon contact of the upper surface of the poppet by a probe, the collapsing dome permitting fluid flow from the spout to travel through the at least one slit of the perforated section; and (d) a slidably removable probe.

2. The fitment of claim 1, wherein the probe comprises a generally hollow cylindrical body having a proximal end and a distal end, the distal end forming a nipple capable of mating with a hose, the proximal end having an external surface adapted to mate with the inner surface of the distal end of the cap, the proximal end further having at least one indentation which permits fluid flow through the probe when the dome of the poppet has been collapsed by the probe, the proximal end and distal end being separated by a flange on the outer surface of the probe which extends around the circumference of the probe, the probe when mated with the cap collapsing the dome of the poppet thereby removing the seal between the cap and the poppet to allow fluid flow from the bag through the fitment, and the probe when removed from mating with the cap uncollapsing the dome of poppet thereby resealing the seal between the cap and the poppet.

3. The fitment of claim 2, further comprising a substantially hollow probe duckbill adapted to mate with the inner surface of the probe near the proximal end of the probe, the probe duckbill having a tapered end and a receiving end, the tapered end having a reversibly sealable slit capable of preventing backflow of fluid upon removal of the hose from the probe, the receiving end being in fluid communication with the flow from the spout when the seal between the cap and the poppet has been removed.

4. The fitment of claim 1, wherein the cap further comprises a flip-top lid joined to the cap by a hinge which allows the flip-top lid to move between a closed position on the cap whereby the hollow cylinder section is covered and an open position away from the hollow cylinder.

5. The fitment of claim 1, wherein the cap further comprises a breakable seal which covers the distal end of the cap.

6. The fitment of claim 5, wherein the breakable seal is broken by the first insertion of the probe into the cylinder of the cap.

7. The fitment of claim 5, wherein the breakable seal comprises a thin material selected from the group consisting of plastic, paper or metal foil.

8. The fitment of claim 3 wherein the duckbill is firmly attached to the inner surface of the collar of the cap.

9. The fitment of claim 8 wherein the duckbill is attached by being welded or heat sealed to the collar of the cap.

10. The fitment of claim 1 wherein the reversibly sealable slit of the duckbill is sealed closed and when punctured by the probe is opened and then reseals on removal of the probe.

11. The fitment of claim 4 wherein the hinge of the flip-top lid is recessed into the cap and thereby allowing the flip-top lid to be recessed into the cavity in the cap.

12. The fitment as recited in claim 1, wherein said cap optionally comprises a flange fixedly attached to the outer surface of the outer collar.

* * * * *